US007055921B2

(12) United States Patent
Sumi

(10) Patent No.: US 7,055,921 B2
(45) Date of Patent: Jun. 6, 2006

(54) METHOD FOR DRIVING LIQUID-JET HEAD AND LIQUID-JET APPARATUS

(75) Inventor: Koji Sumi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 124 days.

(21) Appl. No.: 10/761,416

(22) Filed: Jan. 22, 2004

(65) Prior Publication Data

US 2004/0252147 A1 Dec. 16, 2004

(30) Foreign Application Priority Data

Jan. 27, 2003 (JP) ..... 2003-017160

(51) Int. Cl.
*B41J 29/38* (2006.01)

(52) U.S. Cl. ..... 347/10

(58) Field of Classification Search ..... 347/10, 347/68, 70, 71
See application file for complete search history.

(56) References Cited

U.S. PATENT DOCUMENTS 6,830,302 B1 * 12/2004 Masumoto et al. ..... 347/9

FOREIGN PATENT DOCUMENTS

| | | |
|---|---|---|
| JP | 08-192513 | 7/1996 |
| JP | 10-250061 A | 9/1998 |
| JP | 2000-326507 | 11/2000 |
| JP | 2002-234156 | 8/2002 |

* cited by examiner

*Primary Examiner*—Shih-wen Hsieh
(74) *Attorney, Agent, or Firm*—Sughrue Mion, PLLC

(57) ABSTRACT

Disclosed is a method for driving a liquid-jet head comprising a passage-forming substrate in which pressure generating chambers communicating with nozzle orifices are formed; and a piezoelectric element provided on one surface of the passage-forming substrate via a vibration plate, and consisting of a lower electrode, a piezoelectric layer, and an upper electrode. The piezoelectric layer consists of a relaxor ferroelectric. A voltage between a potential $V_1$, at which the capacitance of the piezoelectric element is maximal in a capacitance-potential curve of the piezoelectric element, and a potential $V_2$, which has a larger absolute value than the absolute value of the potential $V_1$ and at which an inflection point in the capacitance-potential curve is reached, is set as a drive start potential $V_0$. The piezoelectric element is driven using a drive waveform having an ejection step for changing the potential from the drive start potential $V_0$ to a potential $V_3$, at which a driving electric field having an electric field strength of 100 to 500 kV/cm is generated in the piezoelectric layer, to contract the pressure generating chamber, thereby ejecting liquid droplets through the nozzle orifice.

8 Claims, 7 Drawing Sheets

METHOD FOR DRIVING LIQUID-JET HEAD AND LIQUID-JET APPARATUS

BACKGROUND OF THE INVENTION

1. Field of the Invention

This invention relates to a method for driving a liquid-jet head in which a portion of a pressure generating chamber communicating with a nozzle orifice for jetting a liquid is constituted of a vibration plate, a piezoelectric element is formed on the surface of the vibration plate, and the liquid is jetted by displacement of the piezoelectric element, and a liquid-jet apparatus equipped with the liquid-jet head.

2. Description of the Related Art

An example of a liquid-jet apparatus is an ink-jet recording apparatus comprising an ink-jet recording head equipped with a plurality of pressure generating chambers for generating pressure for ejection of ink droplets by piezoelectric elements or heating elements; a common reservoir for supplying ink to the respective pressure generating chambers; and nozzle orifices communicating with the respective pressure generating chambers. This ink-jet recording apparatus applies ejection energy to ink within the pressure generating chamber communicating with the nozzle orifice corresponding to a printing signal to eject ink droplets through the nozzle orifice.

The ink-jet recording head is constituted such that a portion of the pressure generating chamber communicating with the nozzle orifice for ejecting ink droplets is composed of a vibration plate, and the vibration plate is deformed by a piezoelectric element to pressurize ink within the pressure generating chamber, thereby ejecting ink droplets through the nozzle orifice. Two types of the ink-jet recording head have found practical use. One of them is a recording head using a piezoelectric actuator of a longitudinal vibration mode which expands and contracts in the axial direction of the piezoelectric element. The other is a recording head using a piezoelectric actuator of a flexural vibration mode.

The former recording head can change the volume of the pressure generating chamber by abutting the end surface of the piezoelectric element against the vibration plate, and enables manufacturing of a head suitable for high density printing. However, this recording head requires a difficult step of cutting and dividing the piezoelectric element in a comb tooth shape in conformity with the array pitch of the nozzle orifices, and also requires an operation for aligning and fixing the divisions of the piezoelectric element to the pressure generating chambers. Consequently, the manufacturing process is complicated.

In the latter recording head, on the other hand, the piezoelectric element can be fabricated and installed on a vibration plate by a relatively simple process which comprises adhering a green sheet of a piezoelectric material in conformity with the shape of the pressure generating chamber, and then sintering the green sheet. However, a certain size of the vibration plate is required because of the usage of flexural vibration, thus posing difficulty in achieving a high density array of the piezoelectric elements.

To resolve the disadvantage of the latter recording head, a recording head has been worked out, in which a uniform piezoelectric material layer is formed throughout the surface of the vibration plate by a film deposition technology, and the piezoelectric material layer is cut and divided into shapes corresponding to the pressure generating chambers by a lithography method, so that piezoelectric elements are formed independently of each other for the respective pressure generating chambers, thereby achieving a high density array of the piezoelectric elements.

As a driving signal for driving the piezoelectric element of the ink-jet recording head, a drive waveform comprising a square wave has been used. The drive waveform comprising the square wave includes a step of performing discharging from an intermediate driving voltage on standby to expand the pressure generating chamber, thereby sucking ink into the pressure generating chamber, a step of maintaining a minimum driving voltage, a step of performing charging to cause contraction of the pressure generating chamber, thereby ejecting ink, a step of maintaining a charging final voltage, and a step of performing discharging to return to the intermediate driving voltage. Ink droplets have been ejected by this drive waveform (see, for example, Japanese Unexamined Patent Publication No. 1998-250061 (pages 3–4, FIG. 3).

However, when the piezoelectric element of the multi-nozzled ink-jet recording head is driven with the use of the above-described conventional drive waveform comprising the square wave, an electric current (electric charges moving in the circuit) becomes high. This high current destroys the driving IC and driving wiring, thus posing the problem that a high density array of the piezoelectric elements and multiple-nozzle arrangement are difficult to attain.

This problem is not limited to the ink-jet recording head for ejection of ink. Needless to say, the problem exists similarly with other liquid-jet heads for ejection liquids other than ink.

SUMMARY OF THE INVENTION

The present invention has been accomplished in the light of the above-mentioned circumstances. It is the object of the invention to provide a method for driving a liquid-jet head which achieves a high density array of piezoelectric elements and multi-nozzle arrangement, involves a low voltage, and decreases in electric current consumption, and a liquid-jet apparatus equipped with the liquid-jet head.

A first aspect of the present invention for solving the above-described problems is a method for driving a liquid-jet head comprising a passage-forming substrate in which pressure generating chambers communicating with nozzle orifices are formed; and a piezoelectric element provided on one surface of the passage-forming substrate via a vibration plate, the piezoelectric element consisting of a lower electrode, a piezoelectric layer, and an upper electrode, wherein the piezoelectric layer consists of a relaxor ferroelectric, a voltage between a potential $V_1$, at which a capacitance of the piezoelectric element is maximal in a capacitance-potential curve of the piezoelectric element, and a potential $V_2$, which has a larger absolute value than an absolute value of the potential $V_1$, and at which an inflection point in the capacitance-potential curve is reached, is set as a drive start potential $V_0$, and the piezoelectric element is driven using a drive waveform having an ejection step for changing a potential from the drive start potential $V_0$ to a potential $V_3$, at which a driving electric field having an electric field strength of 100 to 500 kV/cm is generated in the piezoelectric layer, to contract the pressure generating chamber, thereby ejecting liquid droplets through the nozzle orifice.

According to the first aspect of the invention, the piezoelectric element having the piezoelectric layer consisting of the relaxor ferroelectric is driven by the use of a drive voltage within a predetermined range. As a result, desired distortional deformation can be caused to the piezoelectric element at a low voltage and a low current, and a high density array and multi-nozzle arrangement can be achieved without destruction of the drive IC or the wiring.

A second aspect of the present invention is the method for driving the liquid-jet head according to the first aspect, wherein the drive waveform has, before the ejection step, a first expansion step for changing the potential from an intermediate potential, which has polarity identical with polarity of the drive start potential $V_0$ and has a larger absolute value than an absolute value of the drive start potential $V_0$, to the drive start potential $V_0$ to expand the pressure generating chamber.

According to the second aspect of the invention, the interior of the pressure generating chamber is expanded and then contracted to eject liquid droplets. By so doing, the liquid can be reliably filled into the pressure generating chamber, and stable ejection can be carried out.

A third aspect of the present invention is the method for driving the liquid-jet head according to the first or second aspect, wherein the drive waveform has, after the ejection step, a second expansion step for changing the potential from the potential $V_3$ to an intermediate potential, which has polarity identical with polarity of the potential $V_3$ and has a smaller absolute value than an absolute value of the potential $V_3$, to expand the pressure generating chamber.

According to the third aspect of the invention, the displaced piezoelectric element can be restored to its original state by the second expansion step.

A fourth aspect of the present invention is the method for driving the liquid-jet head according to any one of the first to third aspects, wherein the drive waveform further has, after the ejection step, a relaxation step for changing the potential from a predetermined intermediate potential to a potential $V_4$, which has polarity identical with polarity of the drive start potential $V_0$ and has a smaller absolute value than an absolute value of the drive start potential $V_0$, and then returning the potential from said potential $V_4$ to the intermediate potential.

According to the fourth aspect of the invention, the distortion of the piezoelectric element is relaxed by the relaxation step. In the subsequent ejection step, therefore, a predetermined amount of displacement can be caused reliably to the piezoelectric element, so that the size of liquid droplets ejected is stabilized.

A fifth aspect of the present invention is the method for driving the liquid-jet head according to any one of the first to fourth aspects, wherein the drive waveform further has, after the ejection step, an initialization step for changing the potential from a predetermined intermediate potential to a potential $V_5$, which is $-V_3$, and then returning the potential from the potential $V_5$ to the intermediate potential.

According to the fifth aspect of the invention, the distortion of the piezoelectric element is relaxed by the initialization step. In the subsequent ejection step, therefore, a predetermined amount of displacement can be caused reliably to the piezoelectric element, so that the size of liquid droplets ejected is stabilized.

A sixth aspect of the present invention is the method for driving the liquid-jet head according to any one of the first to fifth aspects, wherein a film thickness of the piezoelectric layer is 0.5 to 1.0 μm.

According to the sixth aspect of the invention, the use of the piezoelectric layer with a predetermined film thickness makes it possible to obtain a desired electric field strength at a low voltage, and a predetermined amount of displacement can be reliably produced. Moreover, the piezoelectric elements can be arrayed in high density, high quality printing can be realized, and high frequency driving becomes possible. Thus, high speed printing can be achieved.

A seventh aspect of the present invention is the method for driving the liquid-jet head according to any one of the first to sixth aspects, wherein the passage-forming substrate consists of a single crystal silicon substrate, and each layer of the piezoelectric element is formed by film deposition and lithography.

According to the seventh aspect of the invention, the pressure generating chambers can be formed in the passage-forming substrate easily and with a high degree of accuracy. Moreover, the piezoelectric elements can be arrayed at a high density. Consequently, high speed printing can be achieved.

An eighth aspect of the present invention is a liquid-jet apparatus mounted with a liquid-jet head comprising a passage-forming substrate in which pressure generating chambers communicating with nozzle orifices are formed; and a piezoelectric element provided on one surface of the passage-forming substrate via a vibration plate, the piezoelectric element consisting of a lower electrode, a piezoelectric layer, and an upper electrode, wherein the piezoelectric layer consists of a relaxor ferroelectric, a voltage between a potential $V_1$, at which a capacitance of the piezoelectric element is maximal in a capacitance-potential curve of the piezoelectric element, and a potential $V_2$, which has a larger absolute value than an absolute value of the potential $V_1$ and at which an inflection point in the capacitance-potential curve is reached, is set as a drive start potential $V_0$, and the liquid-jet apparatus further comprises drive means for outputting a drive waveform to the piezoelectric element, the drive waveform having an ejection step for changing a potential from the drive start potential $V_0$ to a potential $V_3$, at which a driving electric field having an electric field strength of 100 to 500 kV/cm is generated in the piezoelectric layer, to contract the pressure generating chamber, thereby ejecting liquid droplets through the nozzle orifice.

According to the eighth aspect of the invention, the piezoelectric element having the piezoelectric layer consisting of the relaxor ferroelectric is driven by the use of a drive voltage within a predetermined range. As a result, desired distortional deformation can be caused to the piezoelectric element at a low voltage and a low current, and a high density array and multi-nozzle arrangement can be achieved without destruction of the drive IC or the wiring. Consequently, high quality printing can be achieved.

BRIEF DESCRIPTION OF THE DRAWINGS

For a more complete understanding of the present invention and the advantages thereof, reference is now made to the following descriptions in conjunction with the accompanying drawings.

DESCRIPTION OF THE PREFERRED EMBODIMENTS

The present invention will now be described in detail based on the embodiments offered below.

Embodiment 1

Figure 1:
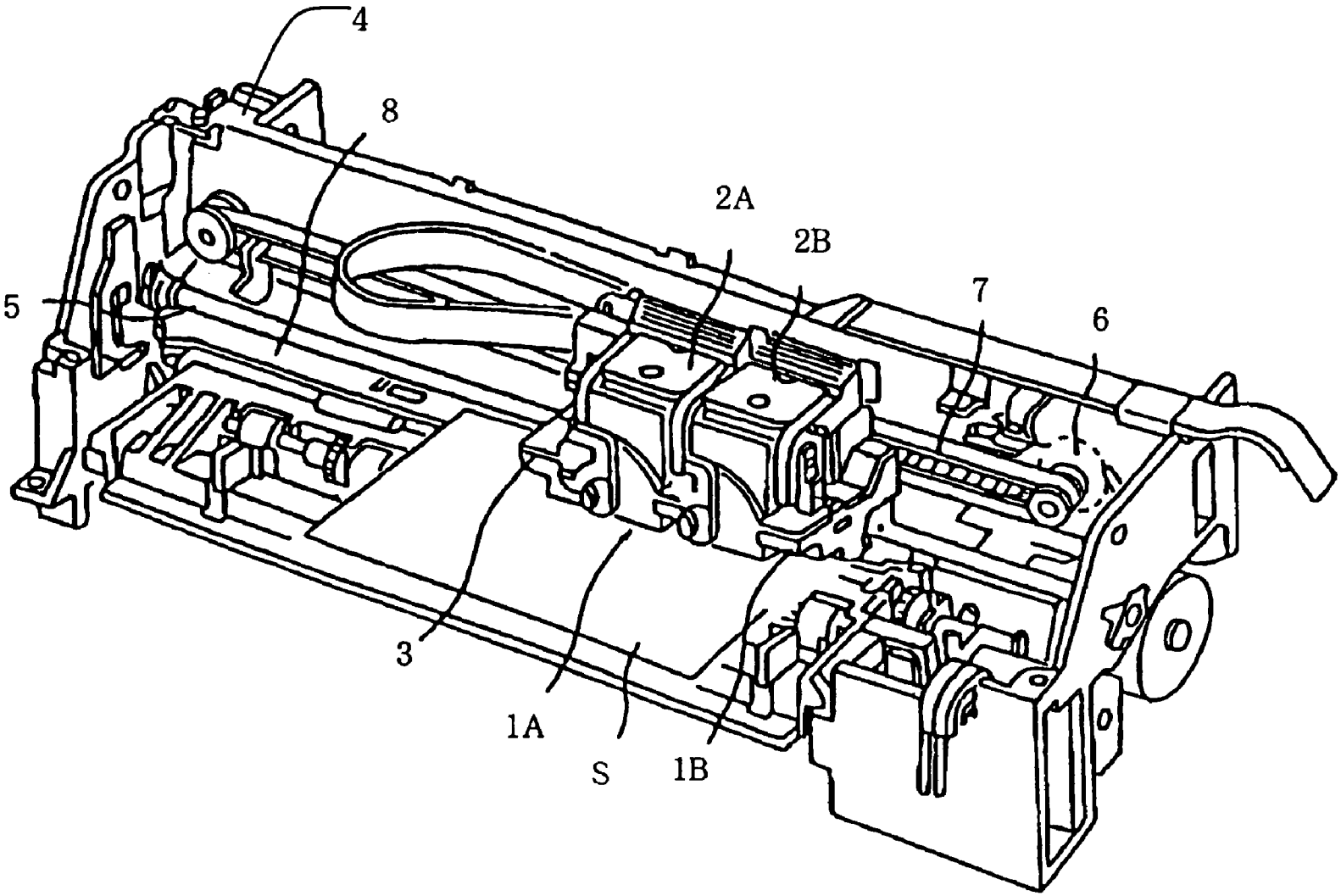
FIG. 1 is a schematic view of the liquid-jet apparatus according to Embodiment 1.

FIG. 1 is a schematic view showing an example of the liquid-jet apparatus according to Embodiment 1. In jet head units 1A and 1B which have liquid-jet heads, as shown in FIG. 1, cartridges 2A and 2B constituting liquid supply means are detachably provided. A carriage 3 having the jet head units 1A and 1B mounted thereon is provided on a carriage shaft 5, which is attached to an apparatus body 4, so as to be movable in the axial direction. The jet head units 1A and 1B are adapted to eject, for example, a black ink composition and a color ink composition, respectively, as liquids.

The driving force of a drive motor 6 is transmitted to the carriage 3 via a plurality of gears (not shown) and a timing belt 7, whereby the carriage 3 bearing the jet head units 1A and 1B is moved along the carriage shaft 5. On the other hand, a platen 8 is provided on the apparatus body 4 along the carriage shaft 5. A recording sheet S, a recording medium, such as paper, fed by a paper feeding roller or the like (not shown) is transported onto the platen 8. With such a liquid-jet apparatus, the carriage 3 is moved along the carriage shaft 5, and also the liquids are ejected by the liquid-jet heads to do printing on the recording sheet S.

Figure 2:
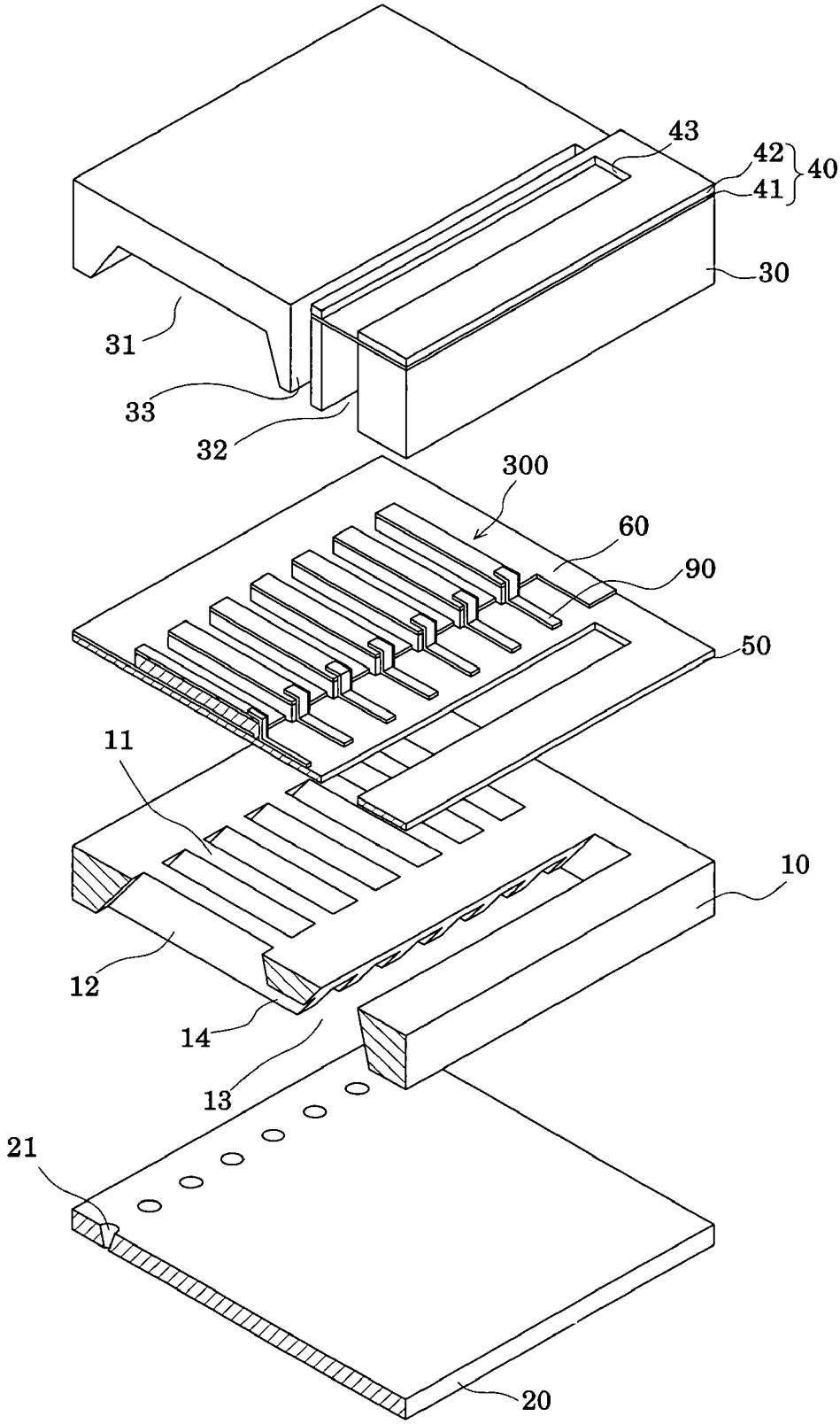
FIG. 2 is an exploded perspective view of the liquid-jet head according to Embodiment 1.
Figure 3A:
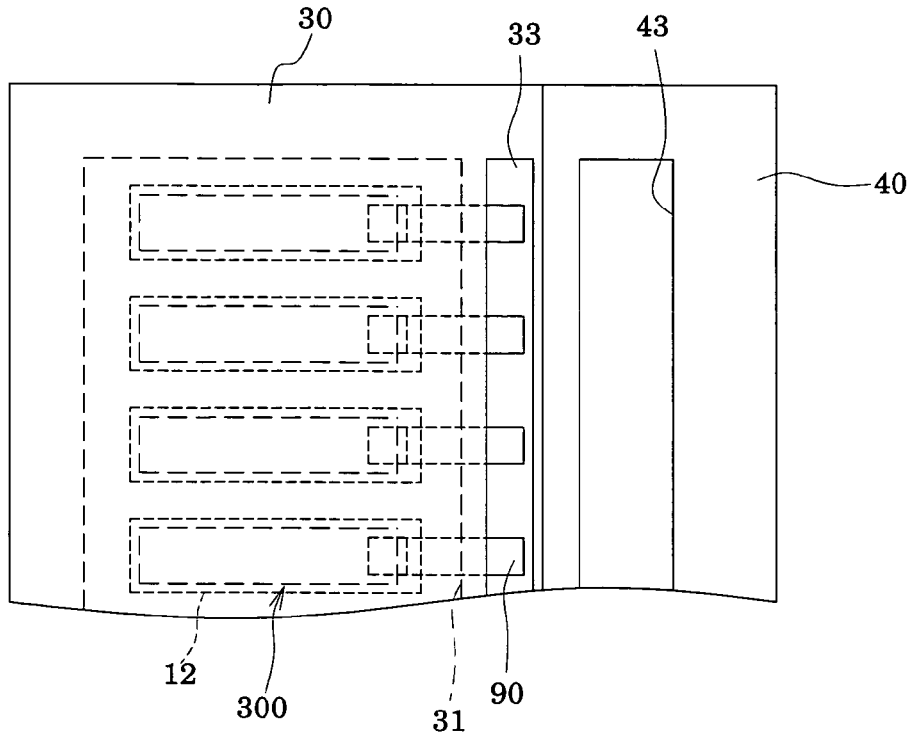
FIGS. 3A and 3B are, respectively, a plan view and a sectional view of the liquid-jet head according to Embodiment 1.
Figure 3B:
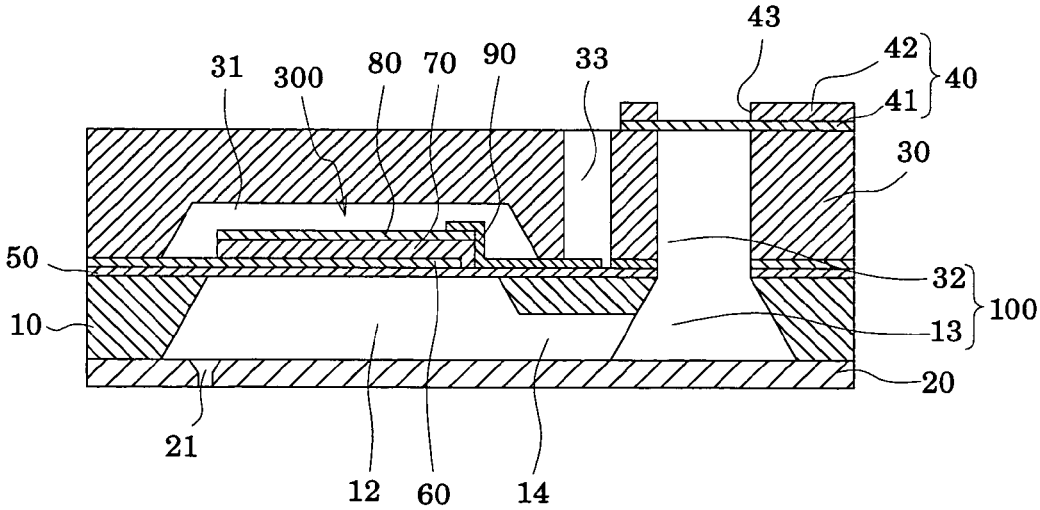

FIG. 2 is an exploded perspective view showing an outline of the liquid-jet head according to Embodiment 1 of the present invention. FIGS. 3A and 3B are a plan view and a sectional view, respectively, of FIG. 2. The liquid-jet head installed in the above-described liquid-jet apparatus will be described with reference to FIGS. 2 and 3A, 3B. As shown in these drawings, a passage-forming substrate 10, in the present embodiment, consists of a single crystal silicon substrate having a plane orientation (100). A 1 to 2 μm thick elastic film 50, composed of silicon oxide ($SiO_2$) formed beforehand by thermal oxidation, is formed on one surface of the passage-forming substrate 10.

In the passage-forming substrate 10, pressure generating chambers 12 divided by a plurality of compartment walls 11 are parallelly provided widthwise by anisotropic etching of the single crystal silicon substrate performed from the one surface thereof. Longitudinally outwardly of the pressure generating chamber 12, a communicating portion 13 to be brought into communication with a reservoir portion 32 of a sealing plate 30 (to be described later on) is formed. The communicating portion 13 is in communication with one end portion in the longitudinal direction of each pressure generating chamber 12 via a liquid supply path 14.

Anisotropic etching is performed by utilizing the difference in the etching rate of the single crystal silicon substrate. In the present embodiment, for example, when the single crystal silicon substrate is immersed in an alkaline solution of KOH or the like, it is gradually eroded, resulting in the appearance of a first (111)-plane perpendicular to the (110)-plane, and a second (111)-plane which makes an angle of about 70 degrees with the first (111)-plane and makes an angle of about 35 degrees with the above (110)-plane. The etching rate for the (111)-plane is about 1/180 the etching rate for the (110)-plane. With the use of these properties, anisotropic etching is carried out. Precision processing can be performed by such anisotropic etching based on depth processing in a parallelogrammatic shape formed by two of the first (111)-planes and two of the second (111)-planes which are inclined. In this manner, the pressure generating chambers 12 can be arrayed at a high density.

In the present embodiment, the long side of each pressure generating chamber 12 is formed from the first (111)-plane, and the short side thereof is formed from the second (111)-plane. This pressure generating chamber 12 is formed by etching carried out until the passage-forming substrate 10 is nearly penetrated and the elastic film 50 is reached. The elastic film 50 has an extremely small amount of erosion by the alkaline solution used for etching the single crystal silicon substrate. Each liquid supply path 14 communicating with one end of each pressure generating chamber 12 is formed more shallowly than the pressure generating chamber 12, thus keeping the passage resistance of the liquid, which flows into the pressure generating chamber 12, at a constant level. That is, the liquid supply path 14 is formed by etching the single crystal silicon substrate halfway in the thickness direction (i.e. half-etching). The half-etching is carried out by adjusting the etching time.

The thickness of the passage-forming substrate 10, in which the pressure generating chambers 12, etc. are formed, is preferably an optimum thickness selected in agreement with the density of the pressure generating chambers 12 disposed. For example, if about 180 of the pressure generating chambers 12 per inch (180 dpi) are to be arranged, it is preferred to set the thickness of the passage-forming substrate 10 at about 180 to 280 μm, more preferably about 220 μm. If the pressure generating chambers 12 are to be arranged at a relatively high density of about 360 dpi, for example, it is preferred to set the thickness of the passage-forming substrate 10 at 100 μm or less. By so doing, a high array density of the pressure generating chambers 12 can be achieved, with the rigidity of the compartment walls 11 between the adjacent pressure generating chambers 12 being maintained. A nozzle plate 20 provided with nozzle orifices 21, which communicate with the pressure generating chambers 12 on a side opposite to the side where the liquid supply paths 14 are located, is secured to an opening surface of the passage-forming substrate 10 via an adhesive or a heat sealing film.

On the elastic film 50 on a side of the passage-forming substrate 10 opposite to its opening surface, a lower electrode film 60 with a thickness, for example, of about 0.2 μm, a piezoelectric layer 70 with a thickness, for example, of about 0.5 to 1.0 μm, and an upper electrode film 80 with a thickness, for example, of about 0.1 μm are sequentially formed in a laminated state to constitute a piezoelectric element 300. Herein, the piezoelectric element 300 refers to a portion which includes the lower electrode film 60, the piezoelectric layer 70, and the upper electrode film 80. Generally, the piezoelectric element 300 is constituted such that any one of the electrodes of the piezoelectric element 300 is used as a common electrode, while the other electrode and the piezoelectric layer 70 are patterned for each pressure generating chamber 12. In this case, a portion, which is composed of any one of the electrodes and piezoelectric layer 70 that have been patterned, and where a piezoelectric distortion is generated by application of a voltage to both electrodes, is referred to as a piezoelectric active portion. In the present embodiment, the lower electrode film 60 is used as a common electrode of the piezoelectric element 300, and the upper electrode film 80 is used as an individual electrode of the piezoelectric element 300. However, there is no problem in reversing this usage for the convenience of a drive circuit or wiring. In any case, the piezoelectric active portion is formed for each pressure generating chamber 12. Herein, a combination of the piezoelectric element 300 and a vibration plate, where displacement occurs upon driving of the piezoelectric element 300, is called a piezoelectric actuator. In the present embodiment, the elastic film 50 and the lower electrode film 60, in combination, serve as the vibration plate.

The respective layers constituting the piezoelectric element 300 are described. In the present embodiment, for example, the lower electrode film 60 is formed in the following manner: Deposition on the entire surface of the elastic film 50 takes place by sputtering. Then, the lower electrode film 60 is patterned to form an entire pattern. The preferred material for the lower electrode film 60 is platinum (Pt) or iridium (Ir). The piezoelectric layer 70 on the lower electrode film 60 is formed from a relaxor ferroelectric. The relaxor ferroelectric refers to a material having a Curie temperature in the vicinity of room temperature, having a dielectric constant larger than that of a piezoelectric such as PZT (for example, a relative dielectric constant of 5,000 or more), and having an electric field-induced distortion greater than that of a piezoelectric such as PZT. For example, a piezoelectric such as PZT gives an electric field-induced distortion of about 0.3%, while a relaxor ferroelectric presents an electric field-induced distortion of about 1.2%. Such a relaxor ferroelectric has a great electric field-induced distortion of about 1.2%, and also has a very large dielectric constant, thus leading to a large driving electric charge amount. The use of a predetermined drive waveform as will be described later can obtain a great deformation without making the driving electric charge amount markedly large.

Examples of such a relaxor ferroelectric are relaxor ferroelectrics containing lead titanate, for example, PMN-PT ($Pb(Mg_{1/3}Nb_{2/3})\ O_3$—$PbTiO_3$), PZN-PT ($Pb(Zn_{1/3}Nb_{2/3})$, $O_3$—$PbTiO_3$), PNN-PT ($Pb(Ni_{1/3}Nb_{2/3})\ O_3$—$PbTiO_3$), PIN-PT ($Pb(In_{1/2}Nb_{1/2})$, $O_3$—$PbTiO_3$), PST-PT ($Pb(Sc_{1/3}Ta_{1/2})\ O_3$—$PbTiO_3$), PSN-PT ($Pb(Sc_{1/3}Nb_{1/2})$, $O_3$—$PbTiO_3$), BS-PT ($BiScO_3$-PT), and $BiYbO_3$-PT.

The piezoelectric layer 70 consisting of the relaxor ferroelectric can be formed by CSD (chemical solution deposition) sputtering, or CVD (chemical vapor deposition). Examples of the CSD method are the sol-gel process, and MOD (metal-organic decomposition). The material for forming the upper electrode film 80 on the piezoelectric layer 70 may be a highly conductive material. For example, many metals such as aluminum, gold, nickel, platinum and iridium, and conductive oxides can be used. In the present embodiment, iridium is deposited as a film by sputtering. A lead electrode 90 consisting of, say, gold (Au) is connected to the upper electrode film 80 of each piezoelectric element 300 having such a constitution. This lead electrode 90 drawn out from a portion near the longitudinal end of each piezoelectric element 300 to a site on the elastic film 50 in a region corresponding to the liquid supply path 14.

A sealing plate 30 having a piezoelectric element holding portion 31 is bonded to the passage-forming substrate 10 on the side where the piezoelectric element 300 is provided. With such a space as not to hamper movements of the piezoelectric element 300 being secured in the piezoelectric element holding portion 31, the sealing plate 30 is capable of sealing this space. The piezoelectric element 300 is sealed up in the piezoelectric element holding portion 31. In the sealing plate 30, there is provided a reservoir portion 32 constituting at least a part of a reservoir 100, which is to serve as a common liquid chamber for each pressure generating chamber 12. The reservoir portion 32 is brought into communication with the communicating portion 13 of the passage-forming substrate 10, as stated earlier, to constitute the reservoir 100 serving as the common liquid chamber for each pressure generating chamber 12.

In the region between the piezoelectric element holding portion 31 and the reservoir portion 32 of the sealing plate 30, i.e., the region corresponding to the liquid supply path 14, a connection hole 33 is provided for penetrating the sealing plate 30 in its thickness direction. External wiring (not shown) is provided on the surface of the sealing plate 30 on the side opposite to the piezoelectric element holding portion 31. The lead electrode 90 drawn out from each piezoelectric element 300 extends to the connection hole 33, and is connected to the external wiring, for example, by wire bonding.

A compliance plate 40, composed of a sealing film 41 and a fixing plate 42, is bonded onto the sealing plate 30. Herein, the sealing film 41 consists of a low rigidity, flexible material (for example, a 6 μm thick polyphenylene sulfide (PPS) film). The fixing plate 42 is formed from a hard material such as a metal (for example, 30 μm thick stainless steel (SUS)). In a region of the fixing plate 42 opposed to the reservoir 100, an opening portion 43 is formed by removing the fixing plate 42 completely in its thickness direction. One surface of the reservoir 100 is sealed with the flexible sealing film 41 alone.

Figure 4:
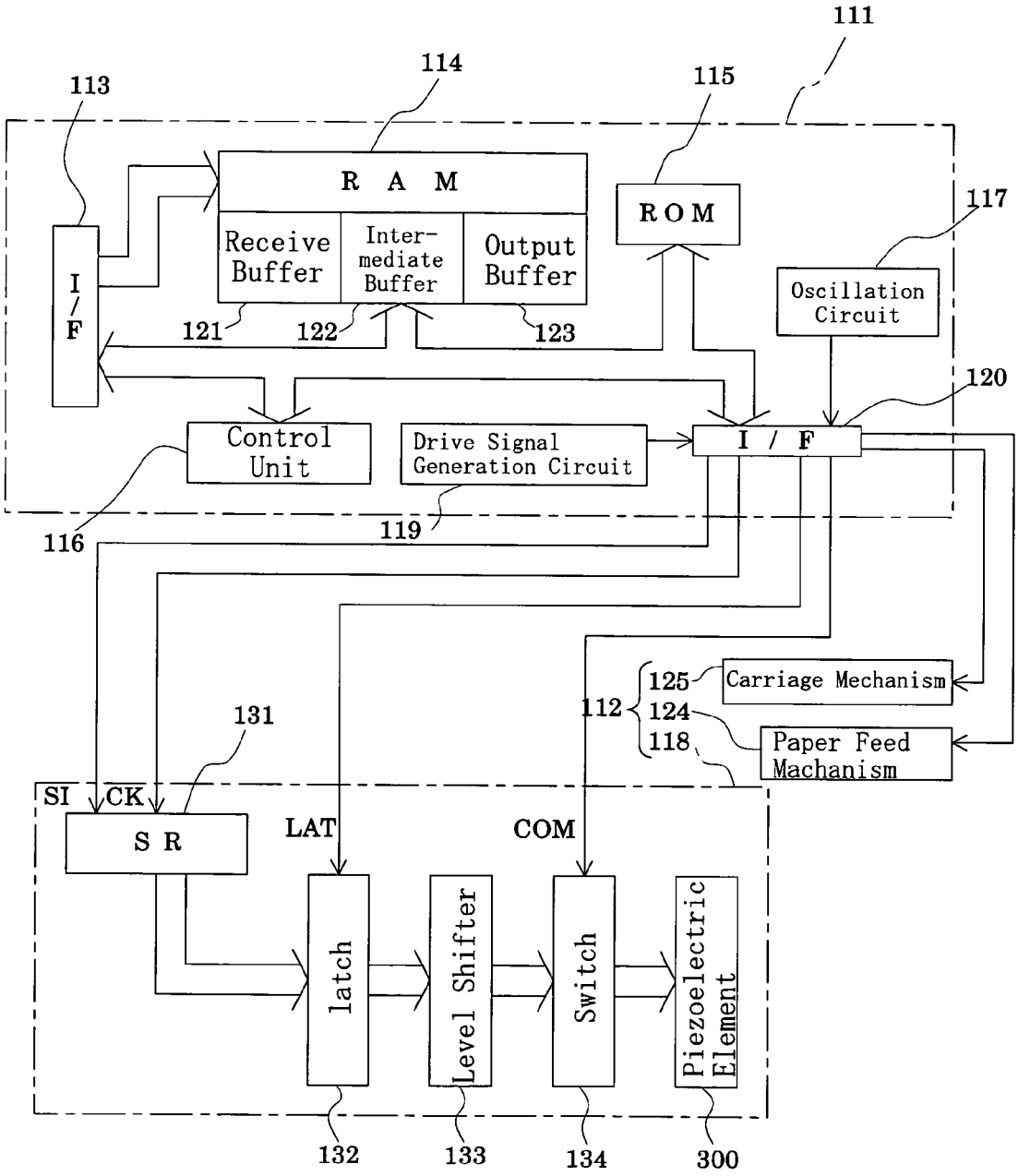
FIG. 4 is a view showing the control configuration of the liquid-jet apparatus according to Embodiment 1.

FIG. 4 is a view showing the control configuration of the liquid-jet apparatus. Control of the liquid-jet apparatus in the present embodiment will be described with reference to FIG. 4. The liquid-jet apparatus in the present embodiment, as shown in FIG. 4, is roughly composed of a printer controller 111 and a print engine 112. The printer controller 111 is furnished with an external interface 113 (hereinafter referred to as the external I/F 113), a RAM 114 for temporarily storing various data, a ROM 115 storing control programs, etc., a control unit 116 including CPU, etc., an oscillation circuit 117 for generating clock signals, a drive signal generation circuit 119 for generating drive signals to be supplied to a liquid-jet head 118, and an internal interface 120 (hereinafter referred to as the internal I/F 120) for transmitting dot pattern data (bit map data), etc., which have been expanded based on drive signals and print data, to the print engine 112.

The external I/F 113 receives print data, which are composed of, for example, character codes, graphic functions, and image data, from a host computer, etc. (not shown). Through the external I/F 113, busy signals (BUSY) or acknowledge signals (ACK) are outputted to the host computer, etc. The RAM 114 functions as a receive buffer 121, an intermediate buffer 122, an output buffer 123, and a work memory (not shown). The receive buffer 121 temporarily stores print data received by the external I/F 113, the intermediate buffer 122 stores intermediate code data converted by the control unit 116, and the output buffer 123 stores dot pattern data. The dot pattern data are composed of print data obtained by decoding (translating) gradation data.

The ROM 115 stores font data, graphic functions, etc. in addition to control programs (control routines) for execution of various data processings. The control unit 116 reads print data out of the receive buffer 121, and causes the intermediate buffer 122 to store intermediate code data obtained upon conversion of the print data. The control unit 116 also analyzes the intermediate code data read out of the intermediate buffer 122, and expands the intermediate code data into dot pattern data by referring to the font data, graphic functions, etc. stored in the ROM 115. After applying necessary decorative treatment, the control unit 116 lets the output buffer 123 store the expanded dot pattern data.

After dot pattern data corresponding to one line for the liquid-jet head 118 have been obtained, the one line-equivalent dot pattern data are outputted to the liquid-jet head 118 through the internal I/F 120. Upon delivery of one line-equivalent of dot pattern data from the output buffer 123, the intermediate code data after expansion are erased from the intermediate buffer 122, and an expansion takes place for next intermediate code data.

The print engine 112 is constituted, including the liquid-jet head 118, a paper feed mechanism 124, and a carriage mechanism 125. The paper feed mechanism 124 is constituted by the paper feed motor, platen 8, etc., and sequentially feeds a print storage medium, such as a recording sheet, in an interlocked relationship with the recording action of the liquid-jet head 118. That is, the paper feed mechanism 124 causes the print storage medium to make a relative movement in a sub-scanning direction.

The carriage mechanism 125 is composed of the carriage 3 capable of bearing the liquid-jet head 118, and a carriage drive portion for running the carriage 3 along a main scanning direction. The running of the carriage 3 moves the liquid-jet head 118 in the main scanning direction. The carriage drive portion is composed of the drive motor 6, timing belt 7, etc., as stated earlier.

The liquid-jet head 118 has many nozzle orifices 21 along the sub-scanning direction, and ejects ink droplets through the nozzle orifices 21 with a timing defined by the dot pattern data, etc. The piezoelectric element 300 of this liquid-jet head 118 is supplied with electrical signals, for example, drive signals (COM) and print data (SI), via external wiring (not shown). In the printer controller 111 and print engine 112 constructed in this manner, drive means is constituted by a latch 132, a level shifter 133 and a switch 134 which enter drive signals having a predetermined drive waveform, outputted from the drive signal generation circuit 119, into the piezoelectric element 300 selectively. With the thus constituted liquid-jet head 118, when a voltage is applied to the piezoelectric element 300, the piezoelectric element 300 warps to displace the vibration plate, whereby the pressure generating chamber 12 contracts. As a result, liquid droplets are ejected through the nozzle orifices 21.

Figure 5:
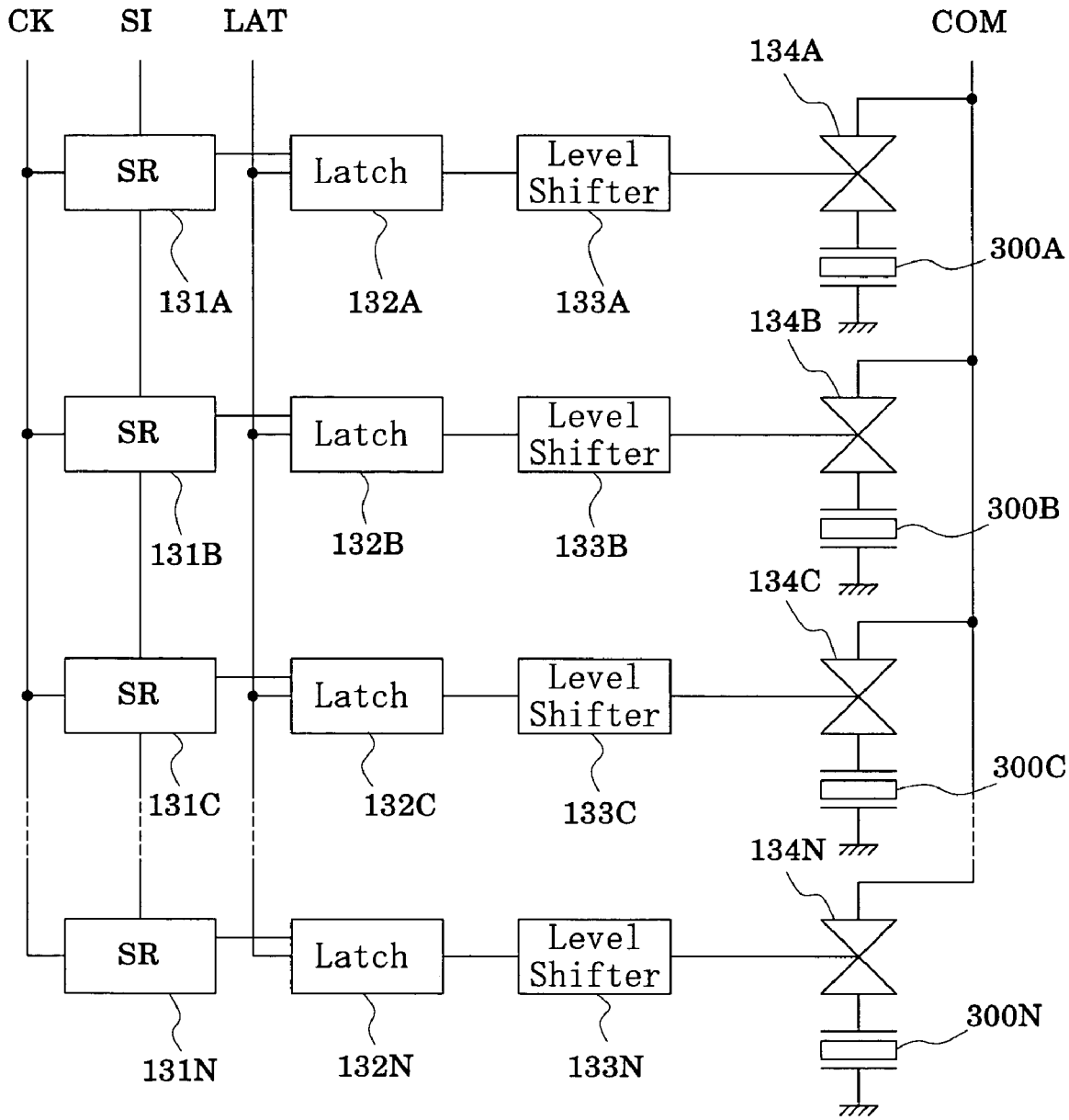
FIG. 5 is a view showing the electrical configuration of the liquid-jet head according to Embodiment 1.
Figure 6:
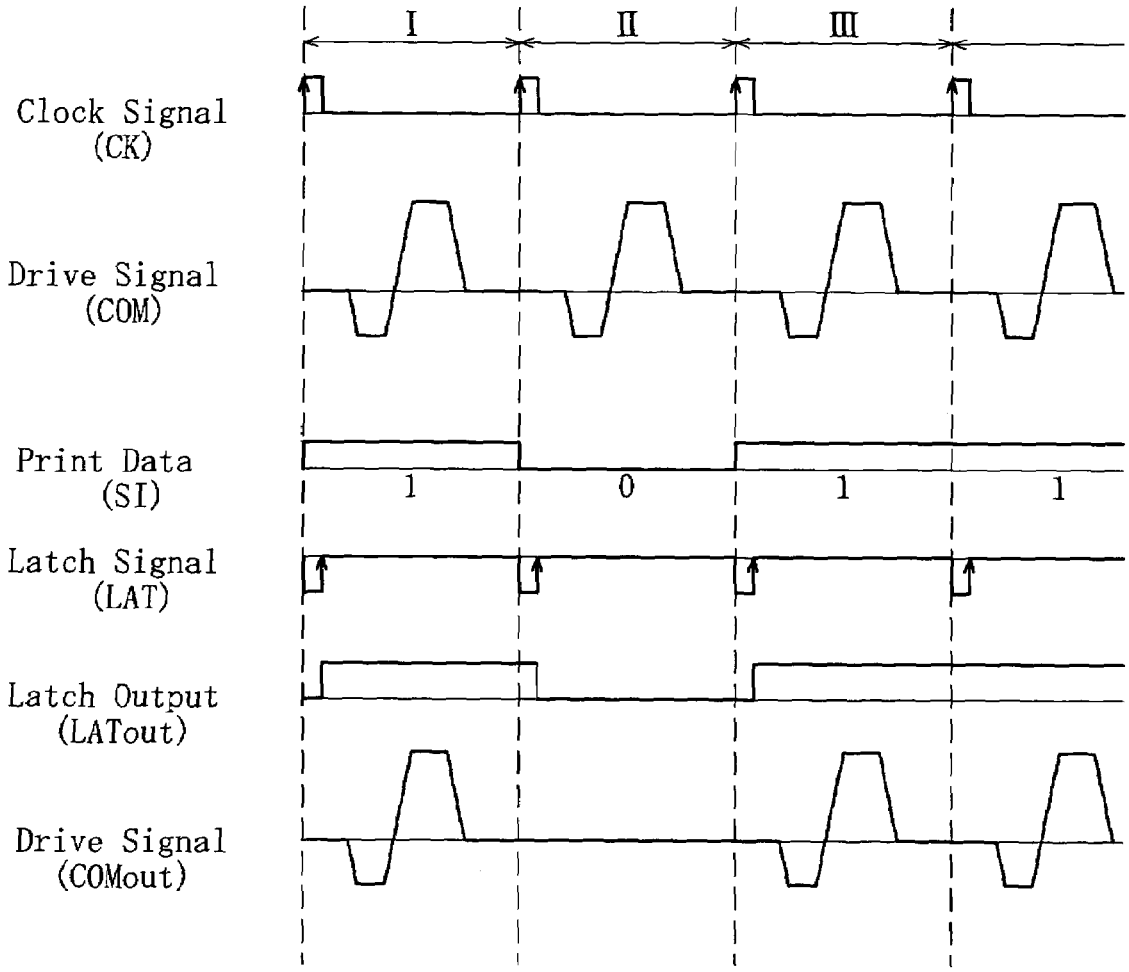
FIG. 6 is a view showing the procedure for application of drive pulses according to Embodiment 1.

FIG. 5 is a schematic view showing the electrical configuration of the liquid-jet head. FIG. 6 is a view showing the procedure for applying drive pulses to the piezoelectric element. The electrical configuration of the liquid-jet head 118 will be described herein. The liquid-jet head 118, as will be shown in FIG. 4, has a shift register 131, a latch 132, a level shifter 133, a switch 134 and a piezoelectric element 300. As shown in FIG. 5, moreover, the shift register 131, latch 132, level shifter 133, switch 134 and piezoelectric element 300 are composed of shift register elements 131A to 131N, latch elements 132A to 132N, level shifter elements 133A to 133N, switch elements 134A to 134N, and piezoelectric element components 300A to 300N, respectively, which are provided for the respective nozzle orifices 21 of the liquid-jet head 118. The shift register 131, latch 132, level shifter 133, switch 134 and piezoelectric element 300 are electrically connected in this sequence. The shift register 131, latch 132, level shifter 133,and switch 134 generate drive pulses from ejection drive signals and relaxation drive signals generated by the drive signal generation circuit 119. The drive pulses refer to applied pulses which are actually applied to the piezoelectric element 300.

Next, control of the liquid-jet head 118 having such an electrical configuration will be explained. First, the procedure for applying drive pulses to the piezoelectric element 300 is described. With the liquid-jet head 118 having such an electrical configuration, the first step is that print data (SI) constituting dot pattern data are serially transmitted from the output buffer 133 to the sift register 131 in synchronism with clock signals (CK) from the oscillation circuit 117, as shown in FIG. 6, and are sequentially set there. In this case, data of the most significant bit among the print data of all nozzle orifices 21 is serially transmitted. After completion of serial transmission of the most significant bit data, data of the second-most significant bit is serially transmitted. Similarly, data of decreasing-significance bits are sequentially transmitted.

When the print data of these bits, corresponding to all nozzle orifices 21, have been set in the shift register elements 131A to 131N, the control unit 116 allows a latch signal (LAT) to be outputted to the latch 132 with a predetermined timing. Based on this latch signal, the latch 132 latches the print data set in the shift register 131. The print data latched by the latch 132 (i.e. LATout) is applied to the level sifter 133 which is a voltage amplifier. The level sifter 133 increases the print data to a voltage value, at which the switch 134 is drivable, for example, to several tens of volts, in case the print data is, for example, "1". This amplified print data is applied to the switch elements 134A to 134N, and the switch elements 134A to 134N enter a connected state owing to the print data.

Drive signals (COM) generated by the drive signal generation circuit 119 are also applied to the switch elements 134A to 134N. When the switch elements 134A to 134N become connected, the drive signals are applied to the piezoelectric element components 300A to 300N connected to the switch elements 134A to 134N. The illustrated liquid-jet head 118 shows how whether or not ejection drive signals should be applied to the piezoelectric element 300 can be controlled depending on the print data. During the period during which the print data is "1", for example, the switch 134 is in a connected state based on the latch signal (LAT). Thus, the drive signal (COMout) can be supplied to the piezoelectric element 300. In accordance with the supplied drive signal (COMout), the piezoelectric element 300 is displaced (deformed). During the period of the print data being "0", the switch 134 is disconnected. Thus, supply of the drive signal to the piezoelectric element 300 is cut off. In this period for which the print data is "0", each piezoelectric element 300 retains the immediately preceding potential, so that the displaced state immediately in advance is maintained.

Figure 7A:
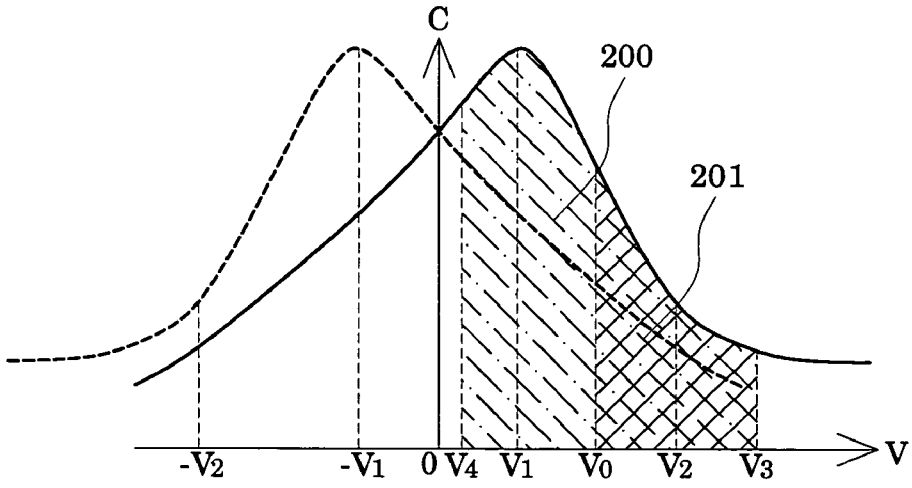
FIGS. 7A to 7C are views showing the characteristics of and drive waveform for the piezoelectric element according to Embodiment 1.
Figure 7B:
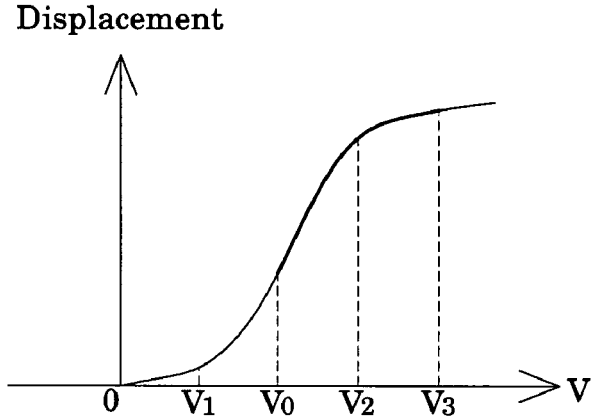
Figure 7C:
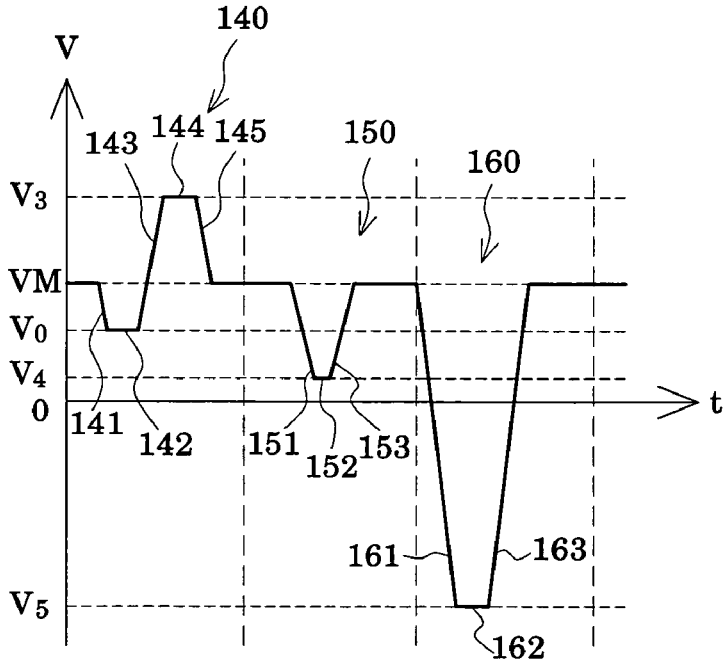

FIG. 7A is a view showing the capacitance-potential curve of the piezoelectric element. FIG. 7B is a view showing the displacement-potential curve of the piezoelectric element. FIG. 7C is a view showing a drive waveform representing drive signals. The drive waveform representing drive signals in the present embodiment will be described with reference to FIGS. 7A to 7C. The piezoelectric layer 70 constituting the piezoelectric element 300 comprises a relaxor ferroelectric as stated earlier. According to a C-V curve showing the capacitance-potential characteristics (C-V characteristics) of the piezoelectric element 300 composed of the piezoelectric layer 70, the piezoelectric element attains a maximum capacitance at a potential $V_1$, ($-V_1$), and reaches an inflection point of the C-V curve at a potential $V_2$ ($-V_2$)

The relationship between the potential and the displacement of the piezoelectric element 300 composed of the piezoelectric layer 70 having C-V characteristics represented by the C-V curve shown in FIG. 7A is expressed in a displacement-potential curve as shown in FIG. 7B. According to this displacement-potential curve, a great displacement of the piezoelectric element 300 can be obtained upon driving of the piezoelectric element 300 using a drive voltage between the potential $V_1$, giving maximum capacitance and the potential $V_2$ at which the inflection point is reached (or between the potential $-V_1$ and the potential $-V_2$). If the piezoelectric element 300 is driven at a drive voltage between the potential $-V_1$ and the potential $V_1$, compared with the drive voltage using a potential between the potential $V_1$, and the potential $V_2$, only a small displacement of the piezoelectric element 300 is obtained. Even if the piezoelectric element 300 is driven at a drive voltage within the range of a potential greater than the potential $V_2$ (or a potential smaller than the potential $-V_2$), a great displacement is not obtained in the piezoelectric element 300. In view of these findings, the piezoelectric element 300 is driven, for displacement, by a drive voltage using a potential between the potential $V_1$, and the potential $V_2$, whereby a desired displacement can be obtained with satisfactory efficiency at a low drive voltage. In the present embodiment, an explanation will be offered hereinbelow using the C-V curve with the potentials $V_1$ and $V_2$ of positive polarity.

The drive waveform representing the drive signals (COM) in the present embodiment, which are entered into the piezoelectric element 300, is a square wave composed of an ejection step 140 for ejecting liquid droplets, a relaxation step 150 for relaxing the distortion history (hysteresis) of the piezoelectric element 300, and an initialization step 160 for initializing the hysteresis of the piezoelectric element 300. The ejection step 140 of the drive waveform is inputted into the piezoelectric element 300 in accordance with the print data, whereby liquid droplets are ejected from the liquid-jet head 118.

The liquid-jet head 118 of the present embodiment is of the so-called "draw-shoot" type. The ejection step 140 of the drive waveform is composed of a first expansion step 141 for lowering the potential from a state, where an intermediate potential VM is maintained, to a drive start potential $V_0$ to expand the pressure generating chamber 12; a first hold step 142 for maintaining the drive start potential $V_0$ for a certain period of time; a contraction step 143 for increasing the potential from the drive start potential $V_0$ to a maximum potential $V_3$ to contract the pressure generating chamber 12, thereby ejecting liquid droplets; a second hold step 144 for maintaining the maximum potential $V_3$ for a certain period of time; and a second expansion step 145 for lowering the potential from the maximum potential $V_3$ to the intermediate potential VM.

The drive start potential $V_0$ is a voltage between the potential $V_1$ and the potential $V_2$ shown in FIG. 7A, the potential $V_1$ being the potential at which the capacitance of the piezoelectric element 300 is maximal, and the potential $V_2$ being the potential which is of the same polarity as the potential $V_1$ and at which the capacitance of the piezoelectric element 300 reaches the inflection point. In the present embodiment, PMN-PT having a film thickness of 0.5 μm, for example, is used as the piezoelectric layer 70 constituting the piezoelectric element 300. As a result, the potential $V_1$, at which the capacitance of the piezoelectric element 300 is maximal, is 1.0 V, while the potential $V_2$, which is of the same polarity as the potential $V_1$ and at which the capacitance of the piezoelectric element 300 reaches the inflection point, is 5.0 V. Thus, it suffices to set the drive start potential $V_0$ at a potential which is larger than 1.0 V, but smaller than 5.0 V.

The maximum potential $V_3$ is such a potential that a driving electric field having an electric field strength of 100 to 500 kV/cm is generated in the piezoelectric layer 70 upon application of a voltage, increased from the drive start potential $V_0$ to the maximum potential $V_3$, to the piezoelectric element 300. The electric field strength of 100 to 500 kV/cm generated in the piezoelectric layer 70 is the drive voltage divided by the film thickness of the piezoelectric layer 70. In the present embodiment, the relaxor ferroelectric comprising PMN-PT is formed into the piezoelectric layer 70 with a film thickness of 0.5 μm. Thus, the drive voltage that makes the electric field strength 100 to 500 kV is 5.0 to 25 V. The maximum potential $V_3$ corresponding to such a drive voltage may be set, as desired, from the values of the drive start potential $V_0$.

The relaxor ferroelectric used as the piezoelectric layer 70 has a great electric field-induced distortion of about 1.2% in comparison with a piezoelectric such as PZT. Thus, the relaxor ferroelectric has such a high a dielectric constant that the amount of drive charges is large for ordinary driving. This drive charge amount is expressed as the integral of the C-V curve shown in FIG. 7A. For example, the drive start potential is set at a potential $V_4$ between the potential zero and the potential $V_1$, and a voltage from the potential $V_4$to the maximum potential $V_3$ is applied to drive the piezoelectric element 300. In this case, the drive charge amount is large as shown in a region 200. In the light of this finding, the drive start potential $-V_0$ is set at a value between the potential $V_1$, and the potential $V_2$. This can cause a relatively great deformation to the piezoelectric element 300, without making the drive charge amount considerably large, as shown in a region 201. By so doing, the piezoelectric element 300 can be driven at a low voltage and with a decrease in electric current consumption, and a load on the circuit can be reduced. Consequently, even when the liquid-jet head 118 is constructed, for example, at a high density of 600 dpi and with multiple nozzles, and even when the piezoelectric elements 300 are simultaneously driven, the drive IC or wiring is not destroyed.

With the ejection step 140 of the drive waveform, the potential is lowered from the maximum potential $V_3$ to the intermediate potential VM in the second expansion step 145, whereby it is attempted to restore the displaced piezoelectric element 300 to the normal state. In fact, the distortion of the piezoelectric element 300 is not fully relaxed, but the displacement of the piezoelectric element 300 is maintained. To avoid this situation, the drive waveform having the relaxation step 150 and the initialization step 160 of the drive waveform is inputted into the piezoelectric element 300 for each plurality of the ejection steps 140 of the drive waveform. By this measure, the distortion of the piezoelectric element 300 is relaxed.

The relaxation step 150 of the drive waveform is composed of a lowering step 151 for lowering the potential from the intermediate potential VM to the potential $V_4$ which is smaller than the initial drive potential $V_0$ and which has the same polarity as the initial drive potential $V_0$; a hold step 152 for maintaining the potential $V_4$ for a certain period of time; and an increasing step 153 for increasing the potential from the potential $V_4$ to the intermediate potential VM. This relaxation step 150 can relax the distortion of the piezoelectric element 300 associated with the ejection step 140. In the next ejection step 140, therefore, the piezoelectric element 300 can be driven with the same distortion as initially applied, whereby stable ejection of liquid droplets can be performed.

The initialization step 160 of the drive waveform is composed of a lowering step 161 for lowering the potential from the intermediate potential VM to a potential $V_5$ which is $-V_3$; a hold step 162 for maintaining the potential $V_5$ for a certain period of time; and an increasing step 163 for increasing the potential from the potential $V_5$ to the intermediate potential VM. This initialization step can initialize the distortion of the piezoelectric element 300 which cannot be relaxed by the relaxation step 150. In the next ejection step 140 as well, the piezoelectric element 300 can be driven with the same distortion as initially applied, whereby stable ejection of liquid droplets can be performed.

The piezoelectric layer 70 constituting the piezoelectric element 300 of the present embodiment consists of a relaxor ferroelectric, and is characterized in that its history of distortion (i.e. hysteresis) is minute compared with a piezoelectric such as PZT. Thus, it is not absolutely necessary to input the relaxation step 150 and the initialization step 160 between the ejection step 140 and the ejection step 140. The relaxation step 150 and the initialization step 160 may be inputted into the piezoelectric element 300 after the ejection step 140 is performed a plurality of times. Alternatively, either the relaxation step 150 or the initialization step 160 may be inputted between a plurality of the ejection steps 140, or both of the relaxation step 150 and the initialization step 160 may be inputted between a plurality of the ejection steps 140.

The tilt of the increasing step 153 or 163 of the relaxation step 150 and the initialization step 160 is not limited, but is preferably rendered relatively small so as not to affect the vibration of a meniscus of the liquid formed in the nozzle orifice 21. The reason is that with the liquid-jet head 118 of the present embodiment, when the piezoelectric element 300 is driven by the increasing step 153 or 163, the pressure generating chamber 12 is contracted to cause vibrations to the meniscus in the direction of ejection of liquid droplets, and thus if the tilt of the increasing step 153 or 163 is rendered great, liquid droplets may be accidentally ejected. If the tilt of the increasing step 153 or 163 is rendered too small, on the other hand, the ejection interval of liquid droplets has to be long, thereby making high speed driving impossible. Hence, the tilt of the increasing step 153 or 163 is desirably rendered as great as possible to such a degree that vibrations of the meniscus are not affected.

OTHER EMBODIMENTS

Embodiment 1 of the present invention has been described above, but the constitution of the present invention is not limited to the foregoing one. In the above Embodiment 1, the drive waveform using the potentials $V_1$ and $V_2$ of positive polarity are illustrated as the C-V curve of the piezoelectric element 300, but it is not limitative. The potentials $V_1$ and $V_2$ of negative polarity may be used for the C-V curve of the piezoelectric element 300. In the case of the potentials $V_1$ and $V_2$ having negative polarity, the potential $V_3$ is a minimum potential which generates a predetermined electric field strength in the piezoelectric layer 70 of the piezoelectric element 300.

According to the above Embodiment 1, moreover, the potentials $V_1$ and $V_2$ that determine the drive start potential $V_0$ are found from the C-V characteristics expressed by the C-V curve of the piezoelectric element 300. However, this mode is not limitative, and comparable values can be obtained if the potentials $V_1$ and $V_2$ that determine the drive start potential $V_0$ are found from dielectric constant-potential characteristics ($\in$-V characteristics) which give a curve equivalent to the C-V curve. Furthermore, the above Embodiment 1 takes as an example the thin film type liquid-jet head produced by application of film deposition and lithography. However,needless to say,this is not restrictive, and the present invention can be used, for example, for a thick film type liquid-jet head formed by a method such as affixing a green sheet.

Besides, the present invention is widely directed to liquid-jet heads as a whole. For example, the invention can be applied to various recording heads, such as ink-jet recording heads for use in image recorders, e.g. printers; coloring material jet heads for use in the production of color filters such as liquid crystal displays; electrode material jet heads for use in the formation of electrodes for organic EL displays and FED (surface-emitting displays); and biological organic matter jet heads for use in the production of biochips. It goes without saying that liquid-jet apparatuses having such liquid-jet heads mounted thereon are not restricted.

Although the preferred embodiments of the present invention have been described in detail, it should be understood that various changes, substitutions and alterations can be made therein without departing from the spirit and scope of the invention as defined by the appended claims.

What is claimed is:

1. A method for driving a liquid-jet head comprising a passage-forming substrate in which pressure generating chambers communicating with nozzle orifices are formed; and a piezoelectric element provided on one surface of said passage-forming substrate via a vibration plate, said piezoelectric element consisting of a lower electrode, a piezoelectric layer, and an upper electrode, wherein said piezoelectric layer consists of a relaxor ferroelectric, a voltage between a potential $V_1$, at which a capacitance of said piezoelectric element is maximal in a capacitance-potential curve of said piezoelectric element, and a potential $V_2$, which has a larger absolute value than an absolute value of said potential $V_1$ and at which an inflection point in said capacitance-potential curve is reached, is set as a drive start potential $V_0$, and said piezoelectric element is driven using a drive waveform having an ejection step for changing a potential from said drive start potential $V_0$ to a potential $V_3$, at which a driving electric field having an electric field strength of 100 to 500 kV/cm is generated in said piezoelectric layer, to contract said pressure generating chamber, thereby ejecting liquid droplets through said nozzle orifice.

2. The method for driving the liquid-jet head according to claim 1, wherein said drive waveform has, before said ejection step, a first expansion step for changing the potential from an intermediate potential, which has polarity identical with polarity of said drive start potential $V_0$ and has a larger absolute value than an absolute value of said drive start potential $V_0$, to said drive start potential $V_0$ to expand said pressure generating chamber.

3. The method for driving the liquid-jet head according to claim 1, wherein said drive waveform has, after said ejection step, a second expansion step for changing the potential from said potential $V_3$ to an intermediate potential, which has polarity identical with polarity of said potential $V_3$ and has a smaller absolute value than an absolute value of said potential $V_3$, to expand said pressure generating chamber.

4. The method for driving the liquid-jet head according to claim 1, wherein said drive waveform further has, after said ejection step, a relaxation step for changing the potential from a predetermined intermediate potential to a potential $V_4$, which has polarity identical with polarity of said drive start potential $V_0$ and has a smaller absolute value than an absolute value of said drive start potential $V_0$, and then returning the potential from said potential $V_4$ to said intermediate potential.

5. The method for driving the liquid-jet head according to claim 1, wherein said drive waveform further has, after said ejection step, an initialization step for changing the potential from a predetermined intermediate potential to a potential $V_5$, which is $-V_3$, and then returning the potential from said potential $V_5$ to said intermediate potential.

6. The method for driving the liquid-jet head according to claim 1, wherein a film thickness of said piezoelectric layer is 0.5 to 1.0 μm.

7. The method for driving the liquid-jet head according to one of claims 1 to 6, wherein said passage-forming substrate consists of a single crystal silicon substrate, and each layer of said piezoelectric element is formed by film deposition and lithography.

8. A liquid-jet apparatus mounted with a liquid-jet head comprising a passage-forming substrate in which pressure generating chambers communicating with nozzle orifices are formed; and a piezoelectric element provided on one surface of said passage-forming substrate via a vibration plate, said piezoelectric element consisting of a lower electrode, a piezoelectric layer, and an upper electrode, wherein said piezoelectric layer consists of a relaxor ferroelectric, a voltage between a potential $V_1$, at which a capacitance of said piezoelectric element is maximal in a capacitance-potential curve of said piezoelectric element, and a potential $V_2$, which has a larger absolute value than an absolute value of said potential $V_1$ and at which an inflection point in said capacitance-potential curve is reached, is set as a drive start potential $V_0$, and said liquid-jet apparatus further comprises drive means for outputting a drive waveform to said piezoelectric element, said drive waveform having an ejection step for changing a potential from said drive start potential $V_0$ to a potential $V_3$, at which a driving electric field having an electric field strength of 100 to 500 kV/cm is generated in said piezoelectric layer, to contract said pressure generating chamber, thereby ejecting liquid droplets through said nozzle orifice.

* * * * *